US010264386B1

(12) United States Patent
Kleijn

(10) Patent No.: US 10,264,386 B1
(45) Date of Patent: Apr. 16, 2019

(54) DIRECTIONAL EMPHASIS IN AMBISONICS

(71) Applicant: Google LLC, Mountain View, CA (US)

(72) Inventor: Willem Bastiaan Kleijn, Eastborne Wellington (NZ)

(73) Assignee: GOOGLE LLC, Mountain View, CA (US)

( * ) Notice: Subject to any disclaimer, the term of this patent is extended or adjusted under 35 U.S.C. 154(b) by 0 days.

(21) Appl. No.: 15/893,138

(22) Filed: Feb. 9, 2018

(51) Int. Cl.
*H04R 25/00* (2006.01)
*H04S 7/00* (2006.01)
*H04S 3/00* (2006.01)

(52) U.S. Cl.
CPC ..... *H04S 7/303* (2013.01); *H04S 3/008* (2013.01); *H04S 2420/11* (2013.01)

(58) Field of Classification Search
CPC ..... H04R 25/00
See application file for complete search history.

(56) References Cited

U.S. PATENT DOCUMENTS

2013/0010971 A1* 1/2013 Batke ..... G10L 19/008 381/22
2015/0340044 A1* 11/2015 Kim ..... G10L 19/002 381/23
2017/0006401 A1* 1/2017 Kropp ..... H04S 3/008
2017/0011750 A1* 1/2017 Liu ..... G10L 19/008
2017/0048639 A1* 2/2017 Melkote ..... G10L 19/008
2017/0063960 A1* 3/2017 Stockhammer ..... H04L 65/607
2017/0154633 A1* 6/2017 Krueger ..... G10L 19/008
2017/0188174 A1* 6/2017 Lee ..... H04S 7/303
2018/0218740 A1* 8/2018 Kleijn ..... G10L 19/008
2018/0218741 A1* 8/2018 Keiler ..... G10L 19/008
2018/0227665 A1* 8/2018 Elko ..... H04R 1/406
2018/0308496 A1* 10/2018 Kordon ..... H04S 3/008
2018/0324542 A1* 11/2018 Seo ..... H04S 7/303

OTHER PUBLICATIONS

Kleijn, et al., "Incoherent Idempotent Ambisonics Rendering", IEEE Workshop on Applications of Signal Processing to Audio and Acoustics, Oct. 15-18, 2017, 5 pages.
Poletti, "Three-dimensional surround sound systems based on spherical harmonics", Journal of the Audio Engineering Society, vol. 53, No. 11, Nov. 2005, pp. 1004-1025.
Williams, "Fourier acoustics: sound radiation and nearfield acoustical holography", The Journal of the Acoustical Society of America 108 (4), Oct. 2000, pp. 1373-1374.
Wu, et al., "Theory and Design of Soundfield Reproduction Using Continuous Loudspeaker Concept", IEEE Transactions on Audio, Speech, and Language Processing, vol. 17, No. 1, Jan. 2009, pp. 107-116.

* cited by examiner

*Primary Examiner* — Olisa Anwah
(74) *Attorney, Agent, or Firm* — Brake Hughes Bellermann LLP

(57) ABSTRACT

Techniques of rendering high-order ambisonics (HOAs) involve adjusting the weights of a spherical harmonic (SH) expansion of a sound field based on weights of a SH expansion of a direction emphasis function that multiplies a monopole density that, when its product with a Green's function is integrated over the unit sphere, produces the sound field. An advantage of the improved techniques lies in the ability to better reproduce directionality of a given sound field in a computationally manner, whether the sound field is a temporal function or a time-frequency function.

20 Claims, 4 Drawing Sheets

DIRECTIONAL EMPHASIS IN AMBISONICS

TECHNICAL FIELD

This description relates to rendering of sound fields in virtual reality (VR) and similar environments and, in particular, to directional emphasis in ambisonics.

BACKGROUND

Ambisonics provides a full-sphere surround sound technique. In addition to providing surround sound in the horizontal plane, ambisonics also covers sound sources above and below the listener. Unlike other multichannel surround formats, ambisonics transmission channels do not carry speaker signals but instead contain a speaker-independent representation of a sound field called B-format, which is then decoded to the listener's speaker setup. This extra step allows the producer to design audio in terms of source directions rather than in terms of loudspeaker positions, and offers the listener a considerable degree of flexibility as to the layout and number of speakers used for playback.

In ambisonics, an array of virtual loudspeakers surrounding a listener can generate a sound field by decoding a B-format sound file generated from a sound source that is isotropically recorded. In an example implementation, such decoding can be used in the delivery of audio through headphone speakers in Virtual Reality (VR) systems. Binaurally rendered high-order ambisonics (HOA) refers to the creation of many (e.g., at least 16) virtual loudspeakers that combine to provide a pair of signals to left- and right-channel speakers.

SUMMARY

In one general aspect, a method can include receiving, by controlling circuitry of a sound rendering computer configured to render directional sound fields for a listener, sound data resulting from a sound field detected at a microphone, the sound field being represented as a first expansion in spherical harmonic (SH) functions and including a vector of coefficients of the first expansion. The method can also include obtaining, by the controlling circuitry, a vector of coefficients of a second expansion of a direction emphasis field in SH functions, the direction emphasis field producing a direction-emphasized monopole density field upon multiplication with a monopole density field. The method can further include performing, by the controlling circuitry, a direction emphasis operation on the vector of coefficients of the first expansion based on the vector of coefficients of the second expansion to produce a vector of coefficients of a third expansion into SH functions, the third expansion representing a direction-emphasized sound field that reproduces a directional sound field with a perceived directionality and timbre.

The details of one or more implementations are set forth in the accompa-nying drawings and the description below. Other features will be apparent from the description and drawings, and from the claims.

DETAILED DESCRIPTION

Rendering HOA sound fields can involve summing a weighted sequence of components from each HOA channel and from each source direction. When expressed in a spherical coordinate basis, each component itself can have temporal, angular, and radial terms. The angular term can be expressed as a spherical harmonic function, while the radial factor can be expressed as a spherical Bessel function. Truncation of the sequence of components leads to an accurate description of the sound field within a certain radius (region of sufficient fidelity, or SF) and below a certain frequency. For some applications, the SF can be on the order of the size of a human head.

Nevertheless, because the size of the SF is inversely proportional to the frequency, for a given truncation length, low frequencies will have a greater reach and therefore the signal timbre generally changes as one moves away from the origin. Increasing the number of components $Q=(\bar{Q}+1)^2$ is an inefficient way of improving performance because, for a particular frequency, the size of the SF is approximately proportional to the square root of the number of components. In some cases, this size can be smaller than the human head.

One conventional approach to rendering ambisonics outside of the SF involves determining a set of source driving signals that produce the Q coefficients ("ambisonic signals") B of a spherical harmonic (SH) expansion of the measured sound field in the SF. Determining these source driving signals involves solving an underdetermined linear system for the source driving signals. Because such an underdetermined system results in multiple possible signals that produce the measured sound field, one may apply the additional constraint of minimizing the energy of the signals to obtain a single solution or a reduced number of solutions.

Nevertheless, such a conventional approach can result in unnatural sound fields outside the SF, because the additional constraint of minimizing energy of the source driving signals tends to spread audio energy out evenly over a sphere on which the sources are placed. This spreading of the audio energy minimizes the ability of a decoder to describe directionality.

Thus, as described herein and in contrast with the above-described conventional approaches to rendering HOA sound fields, improved techniques can include adjusting the coefficients B based on coefficients of a spherical harmonic (SH) expansion of an emphasis function that multiplies a monopole density that, when its product with a Green's function is integrated over the unit sphere, produces the sound field. An advantage of the improved techniques is the ability to better reproduce directionality of a given sound field in a computationally efficient manner. The sound field may be a temporal function or a time-frequency function.

Figure 1:
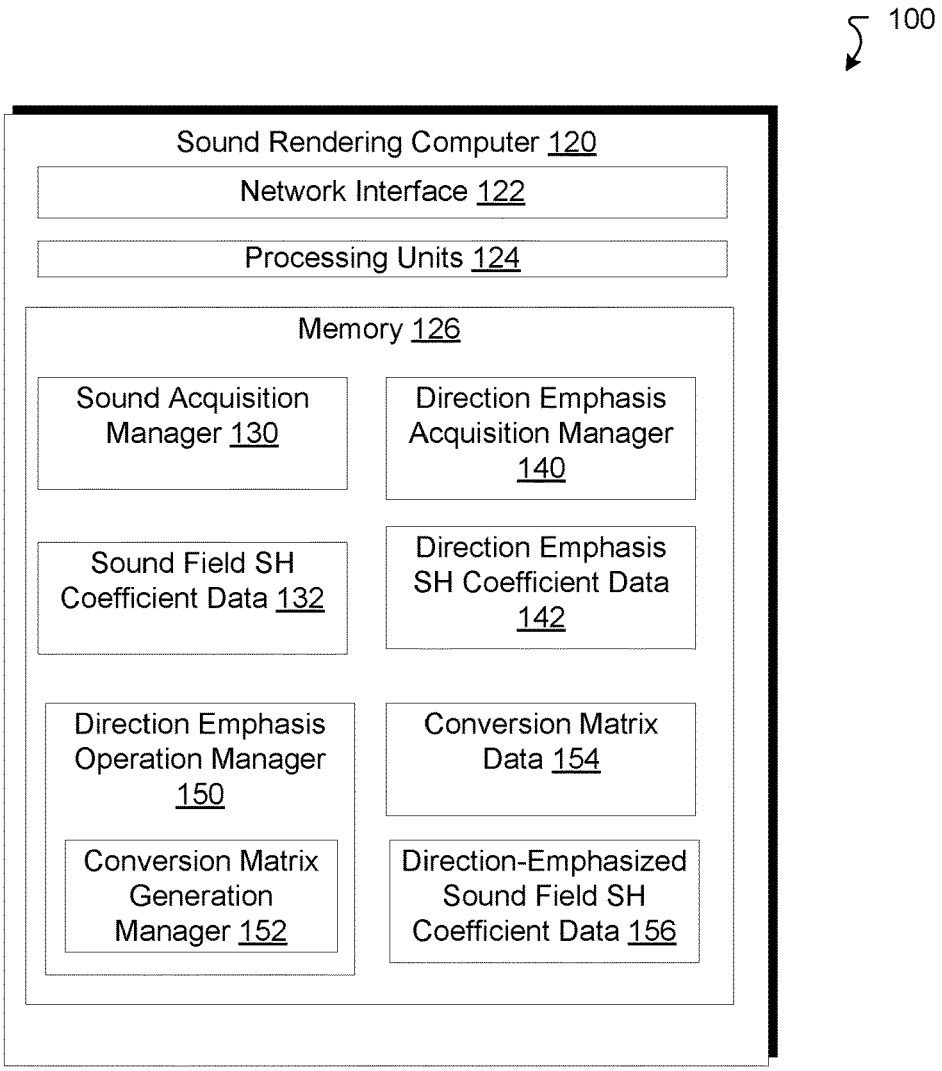
FIG. 1 is a diagram that illustrates an example electronic environment for implementing improved techniques described herein.

FIG. 1 is a diagram that illustrates an example system 100 in which the above-described improved techniques may be implemented. The system 100 can include a sound rendering computer 120 that is configured to render sound fields for a listener. The sound rendering computer 120 can include a network interface 122, one or more processing units 124, and memory 126. The network interface 122 can include, for example, Ethernet adaptors, Token Ring adaptors, etc., for converting electronic and/or optical signals received from a network into an electronic form for use by the sound rendering computer 120. The set of processing units 124 can include one or more processing chips and/or assemblies. The memory 126 can include both volatile memory (e.g., RAM) and non-volatile memory, such as one or more ROMs, disk drives, solid state drives, etc. The set of processing units 124 and the memory 126 together form control circuitry, which is configured and arranged to carry out various methods and functions as described herein.

In some embodiments, one or more of the components of the sound rendering computer 120 can include processors (e.g., processing units 124) configured to process instructions stored in the memory 126. Examples of such instructions include a sound acquisition manager 130, a direction emphasis acquisition manager 140, and a direction emphasis operation manager 150. In addition, the memory 126 can be configured to store various data, which is described with respect to the respective managers that use such data.

The sound acquisition manager 130 can be configured to acquire sound field spherical harmonic (SH) coefficient data 132. The sound acquisition manager 130 may obtain the sound field SH coefficient data 132 from an optical drive or over the network interface 122 and can store the obtained sound field SH coefficient data 132 in memory 126.

In some implementations, the sound field SH coefficient data 132 corresponds to B-format, or first-order ambisonics with four components, or ambisonic channels. In some implementations, the sound field SH coefficient data 132 corresponds to higher-order ambisonics, e.g., to order Q, in which case there are $Q=(\overline{Q}+1)^2$ ambisonic channels, with each channel corresponding to a term in a spherical harmonic (SH) expansion of a sound field emanating from distant sources over a sphere.

In general, a sound field can be represented as an expansion of a pressure field p into spherical harmonics as follows:

$$p(r,\theta,\Phi,k)=\sum_{n=0}^{\infty}\sum_{m=-n}^{n}B_n^m(k)j_n(kr)Y_n^m(\theta,\Phi), \quad \#(1)$$

where k is the wavenumber, c is the speed of sound waves, $j_n$ is the spherical Bessel function of the first kind, $Y_n^m$ is a spherical harmonic, $(\theta,\phi)$ is a point on the unit sphere, and the $B_n^m$ are the (frequency-dependent) coefficients of the spherical harmonic expansion of the pressure field p. The spherical harmonics can take the form:

$$Y_n^m(\theta,\Phi)=(-1)^m\sqrt{\frac{2n+1}{4\pi}\frac{(n-|m|)!}{(n+|m|)!}}P_n^{|m|}(\cos\theta)e^{im\phi}, \quad \#(2)$$

where the $P_n^{|m|}$ are the associated Legendre functions.

The pressure field can be truncated to order $\overline{Q}$, so that there are $Q=(\overline{Q}+1)^2$ terms in the sum as disclosed above. These Q terms can be defined by a coefficient vector $B^{(Q)}$ having Q elements, such that the $q^{th}$ element of $B^{(Q)}$ is $B_{n(q)}^{m(q)}(k)$, where $$n(q)=\lfloor\sqrt{q}\rfloor$$

and $$m(q)=q-\lfloor\sqrt{q}\rfloor(\lfloor\sqrt{q}\rfloor+1).$$

The elements of the coefficient vector $B^{(Q)}$ can form the sound field SH coefficient data 132.

The above-defined pressure field p has an alternative representation in terms of a monopole density μ distributed over a sphere centered at the origin and having a radius r' as follows:

$$p(r,\theta,\phi,k)=\iint_{\Omega}\mu(\theta',\phi',k)G(x,x',k)\sin\theta'^2d\theta'd\phi', \quad \#(3)$$

where Ω is the surface of a sphere (i.e., 4π steradians where $\theta'\in[0,\pi]$ and $\phi'\in[0,2\pi]$), $x=(r,\theta,\phi)$ is an observation point, $x'=(r',\theta',\phi')$ is a point on the sphere over which the monopole density is distributed, and the Green's function G is written as $$\frac{e^{-jk\|x-x'\|}}{4\pi\|x-x'\|'} \quad \#(4a)$$

or, alternatively, for r'>r, as an expansion in SHs:

$$G(x,x',k)=\sum_{n=0}^{\infty}\sum_{m=-n}^{n}(0j)kh_n^{(2)}(kr')j_n(kr)Y_n^{-m}(\theta',\phi')Y_n^m(\theta,\phi), \quad (4b)$$

where $h_n^{(2)}$ is a spherical Hankel function of the second kind. Accordingly, the monopole density may be considered a driving field that provides a source of the pressure field.

The geometry of the driving field/observer situation described above is illustrated in FIG. 2, which illustrates an example sound field environment 200 according to the improved techniques. Within this environment 200, there is an origin 210 (open disk) at which a listener may be located. The monopole density/driving field μ is distributed over a sphere 230 centered at a microphone that can be a spherical microphone located at the origin 210 that measures and records sound field amplitudes as a function of direction away from the origin.

The sound rendering computer 120 is configured to faithfully reproduce the sound field that would exist at an observation point 220 (gray disk) based on sound field data 132 recorded at the origin 210. In doing this, the sound rendering computer 120 is configured to provide a directionality of the sound field at the observation point 220 by determining the amplitude of the driving field over the sphere 230. The directionality of the sound field is a property that allows a listener to discern from which direction a particular sound appears to originate. In this sense, a first sample of a pressure signal over a first window of time (e.g., one second) would result in first coefficients of the driving signal, a second sample of the pressure signal over a second window of time would result in second coefficient, and so on. For each sample of the sound field over a window of time, the coefficients of the pressure signal over frequency as expressed in Eq. (1) are Fourier transforms of the coefficients of the spherical harmonic expansion of the sound field in time.

Figure 2:
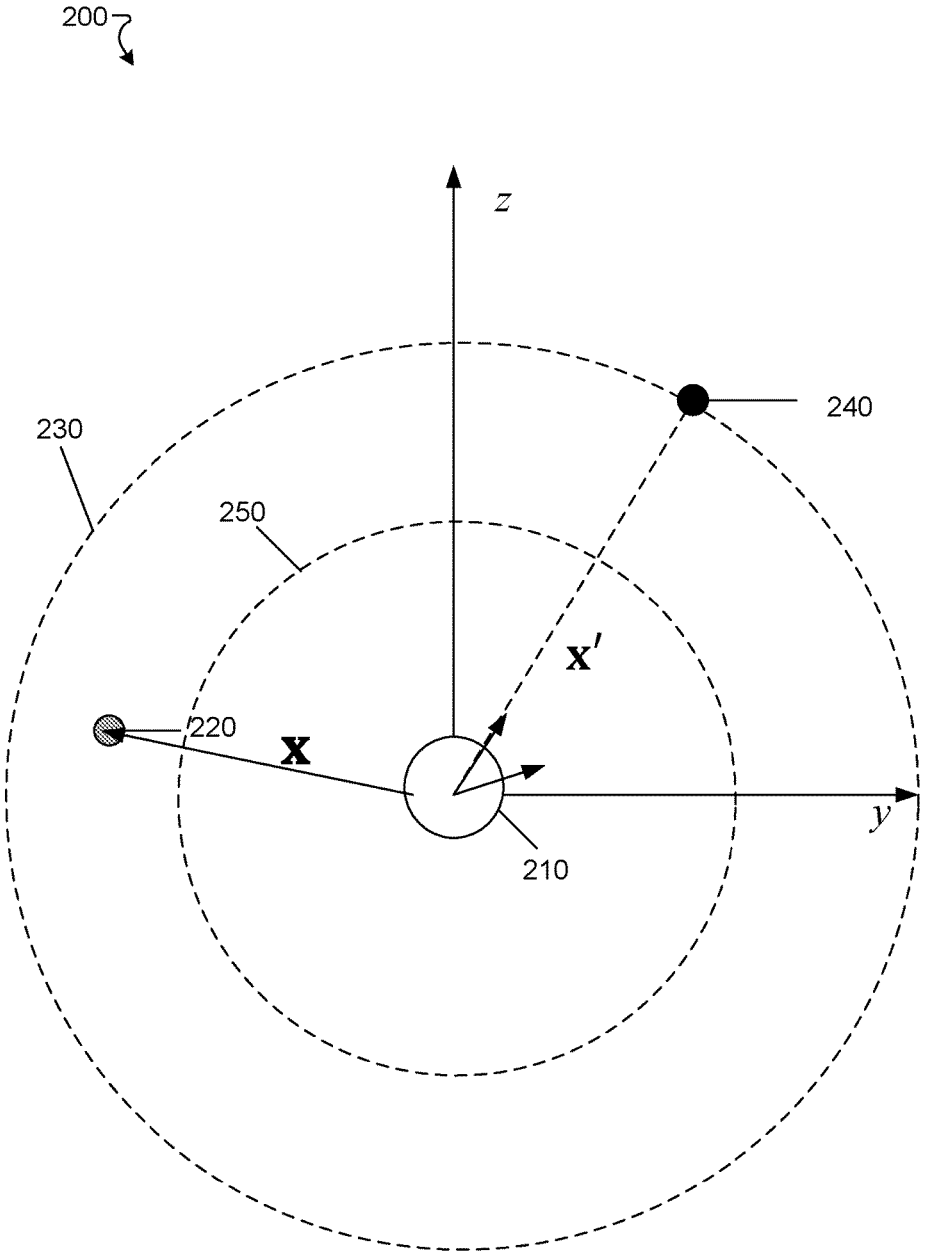
FIG. 2 is a diagram that illustrates example observer position and reference sphere along which monopole sources are distributed with respect to a microphone according to the improved techniques described herein.

As shown in FIG. 2, the observation point 220 is at a position x with respect to the microphone 210. The position x of the observation point 220 is outside of a region of sufficient fidelity (RSF) 250 but inside the sphere 230. In some implementations, the size R of the RSF 250 can be defined such that $\lceil kR \rceil = Q$. A common situation involves a listener's ears being outside of the RSF 250 for higher frequencies.

Returning to FIG. 1, the monopole density μ may be written as an expansion in SHs as follows:

$$\mu(\theta', \phi', k) = \sum_{n=0}^{\infty} \sum_{m=-n}^{n} \gamma_n^m(k) Y_n^m(\theta, \phi). \quad \#(5)$$

The coefficients $\gamma_n^m(k)$ may be expressed in terms of the pressure field coefficients $B_n^m(k)$. To see this, the expressions for the monopole density μ in Eq. (5) and the Green's function in Eq. (4b) may be inserted into Eq. (3). Using the orthogonality of the SHs, the following expression for the pressure field p results:

$$p(r, \theta, \phi, k) \sum_{n=0}^{\infty} \sum_{m=-n}^{n} (-j)kr'^2 \gamma_n^m(k) h_n^{(2)}(kr') j_n(kr) Y_n^m(\theta, \phi). \quad \#(6)$$

By matching the modes in Eqs. (6) and (1), the coefficients of the pressure field and the monopole density may be related as follows:

$$\gamma_n^m(k) = \frac{B_n^m(k)}{(-j)kr'^2 h_n^{(2)}(kr')}. \quad \#(7a)$$

Of interest is the case where the radius r' of the sphere over which the monopole density is distributed is much larger than the size of the SF. In this case, the Hankel function may be replaced by its asymptotic approximation so that the relation in Eq. (7a) is simplified to $$\gamma_n^m(k) = \frac{B_n^m(k)}{r' j^{-m} e^{jkr'}}, \quad \#(7b)$$

so that the monopole density may be simplified to $$\mu(\theta', \phi', k) = \frac{e^{jkr'}}{r'} \sum_{n=0}^{\infty} \sum_{m=-n}^{n} (-j)^n B_n^m(k) Y_n^m(\theta, \phi). \quad \#(8)$$

In some implementations, the pressure field has an explicit time dependence and is operated on in the time domain. In some implementations, the pressure field has both a time dependence and a frequency dependence and is operated on in a mixed time and frequency domain. In this case, a pressure signal p(r,θ,ϕ,k,t) and a driving field signal μ(θ',ϕ',k,t) may be considered, where t represents the time. In some implementations, when the signals are evaluated, the frequency is sampled such that $k \in [0, 2\pi]/c$, where c is the speed of sound, and $t \in \mathbb{Z}$. In addition, the sound field SH coefficient data 132 includes a number of SH coefficient sets corresponding to samples of the pressure signal over time.

Returning to FIG. 1, the direction emphasis acquisition manager 140 is configured to produce a direction emphasis function v by which the directionality of the pressure signal p may be emphasized. In some implementations, the direction emphasis function v has a dependence on the time, t. In some implementations, the direction emphasis function v is independent of the time, t. Accordingly, the direction emphasis function v can be defined as follows:

$$\tilde{\mu}(\theta', \phi', k, t) = v(\theta', \phi', k) \mu(\theta', \phi', k, t), \quad \#(9)$$

where $\tilde{\mu}$ is a direction-emphasized driving field. Accordingly, the direction emphasis function v can be a multiplier of the driving signal μ(θ',ϕ',k,t). Nevertheless, it is not the driving field or monopole density that is of interest, but rather the pressure signal or field.

An objective then is to derive an expression for the SH coefficients of a direction-emphasized pressure signal without computing the driving signal. Thus, the direction emphasis acquisition manager 140 can be configured to acquire direction emphasis SH coefficient data 142 that encapsulates coefficients $V_n^m(k)$ of a SH expansion of the direction emphasis function v:

$$v(\theta', \phi', k) = \sum_{n=0}^{\infty} \sum_{m=-n}^{n} V_n^m(k) Y_n^m(\theta, \phi). \quad \#(10)$$

To derive the SH coefficients of a direction-emphasized pressure signal, the product vμ can be expressed in a SH expansion. To begin, it is recognized again that the expansions of each of the factors μ and v are each truncated rather than infinite. In particular, the driving signal μ, like the pressure field, is truncated to order $\overline{Q}$ so that there are $Q=(\overline{Q}+1)^2$ terms in the sum as disclosed above. These Q terms are defined by a coefficient vector $\gamma^{(Q)}$ having Q elements, such that the $q^{th}$ element of $\gamma^{(Q)}$ is $\gamma_q(k)=\gamma_{n(q)}^{m(q)}(k)$, where, as before, $$n(q) = \lfloor \sqrt{q} \rfloor$$

and $$m(q) = q - \lfloor \sqrt{q} \rfloor (\lfloor \sqrt{q} \rfloor + 1).$$

Similarly, the direction emphasis function v is truncated to order $\overline{L}$, so that there are $L=(\overline{L}+1)^2$ terms in the sum as disclosed above. These L terms are defined by a coefficient vector $V^{(L)}$ having L elements, such that the $l^{th}$ element of $V^{(L)}$ is $V_l(k)=V_{n(ql)}^{m(l)}(k)$, where, as before, $$n(l) = \lfloor \sqrt{l} \rfloor$$

and $$m(l) = l - \lfloor \sqrt{l} \rfloor (\lfloor \sqrt{l} \rfloor + 1).$$

The respective SH expansions at a particular time T sample then take the form $$\mu(\theta', \phi', k, T) = \sum_{q=0}^{Q-1} \gamma_q(k) Y_q(\theta', \phi'), \quad \#(11)$$

$$\nu(\theta', \phi', k) = \sum_{l=0}^{L-1} V_l(k) Y_l(\theta', \phi'), \quad \#(12)$$

where the terms $Y_q(\theta',\phi')=Y_{n(q)}^{m(q)}(\theta',\phi')$ are elements of a SH vector $Y^{(Q)}(\theta',\phi')=[Y_0(\theta',\phi'), Y_1(\theta',\phi'), \ldots, Y_{Q-1}(\theta',\phi')]^T$. Similarly, the terms $Y_l(\theta',\phi')=Y_{n(l)}^{m(l)}(\theta',\phi')$ are elements of a SH vector $Y^{(L)}(\theta',\phi')=[Y_0(\theta',\phi'), Y_1(\theta',\phi'), \ldots, Y_{L-1}(\theta',\phi')]^T$.

The product of the two SH expansions above of degrees $\overline{Q}$ and $\overline{L}$, respectively, may be written as a single SH expansion of degree $\overline{P}\leq\overline{Q}+\overline{L}$. Such a SH expansion may be generated using Clebsch-Gordan coefficients. The result is an expansion over a SH vector $Y^{(P)}(\theta',\phi')$ related to the above SH vectors $Y^{(Q)}(\theta',\phi')$ and $Y^{(L)}(\theta',\phi')$ as follows:

$$Y^{(Q)} \otimes Y^{(L)} = C \cdot Y^{(P)}, \quad \#(13)$$

where $P=(\overline{P}+1)^2$, $C\in\mathbb{R}^{QL\times P}$ is a conversion matrix that includes, as elements, the Clebsch-Gordan coefficients, and $\otimes$ denotes a Kronecker product. The conversion matrix C depends only on the degrees of the SH representations of the driving signal and the direction emphasis function. Accordingly, the conversion matrix C may be computed offline once and stored. In addition, the conversion matrix C is sparse, i.e., it has few nonzero entries.

The direction emphasis operation manager 150 can be configured to generate the coefficients of the SH expansion of the above-described product, i.e., the direction-emphasized sound field SH coefficient data 156. Specifically, the direction emphasis operation manager 150 can include a conversion matrix manager 152 that is configured to generate the conversion matrix data 154 encapsulating the conversion matrix C.

In some implementations, the conversion matrix manager 152 can be configured to produce the conversion matrix data 154 from Eq. (13) based on a random sample of P points on the unit sphere $\{(\theta_i,\phi_i)\}_{i\in\{0,\ldots,P-1\}}$. Once the points on the unit sphere have been determined, the conversion matrix manager 152 can be configured to generate, at each of the plurality of points, samples of $Y^{(Q)}$, $Y^{(L)}$, and $Y^{(P)}$ to form P column vectors $\mathrm{vect}[Y^{(Q)}(\theta_i,\phi^i)Y^{(L)}(\theta_i,\phi_i)]$ (i.e., the Kronecker product of the first two vectors) and P column vectors $Y^{(P)}(\theta_i,\phi_i)$. The conversion matrix manager 152 is then configured to invert the P×P matrix $[Y^{(P)}(\theta_0,\phi_0), \ldots, Y^{(P)}(\theta_{P-1},\phi_{P-1})]$ to produce the conversion matrix data 154.

By substituting the relation in Eq. (13) and the SH expansions in Eqs. (11) and (12) into Eq. (9), the following SH expansion of the direction-emphasized driving signal results:

$$\tilde{\mu}(\theta', \phi', k, T) = \sum_{i=0}^{P-1} Y_i [C^T \cdot (Y^{(Q)} \otimes V^{(L)})]_i. \quad \#(14)$$

Substituting the result in Eq. (7b) into Eq. (14) produces the direction-emphasized pressure signal SH expansion coefficients encapsulated by the direction-emphasized sound field SH coefficient data 156:

$$g^{(P)} \circ \tilde{B}^{(Q)} = C^T \cdot ((g^{(Q)} \circ B^{(Q)}) \otimes V^{(L)}), \quad \#(15)$$

where $g^{(Q)}$ is a vector whose $q^{th}$ element is $(-j)^{n(q)}$, and so on. Thus, equation (15) implies that the direction emphasis results in a higher-order ambisonics representation. With $\circ$ defined as a Hadamard (element-wise) product, the direction-emphasized pressure signal is then, by Eq. (1):

$$\tilde{p}(r, \theta, \phi, k, T) = \sum_{i=0}^{P-1} Y_i j_{n(i)}(kr) g_{n(i)}^{-1} [C^T \cdot ((g^{(Q)} \circ B^{(Q)}) \otimes V^{(L)})]_i, \quad \#(16)$$

where $$n(i) = \lfloor \sqrt{i} \rfloor.$$

Accordingly, the affection emphasis operation manager 150 can be configured to produce the coefficients $\tilde{B}^{(Q)}$ as in Eq. (15) and to generate the direction-emphasized pressure signal (or field if static) as in Eq. (16).

Because the conversion matrix C is sparse, the computation of the direction-emphasized pressure signal SH expansion coefficients is efficient. For example, when $\overline{Q}=1$ (i.e., degree-1 pressure signal) and $\overline{L}=2$ (degree-2 direction emphasis function), the transpose of the conversion matrix $C^T$ has dimensions 16×36. However, only 48 of the 576 matrix elements are nonzero, resulting in four multiplies per output channel per time sample. One issue is that the selection of those non-zero entries by the direction emphasis operation manager 150 may require additional operations.

In some implementations, when the direction emphasis function v is independent of the time t, the direction emphasis operation manager 150 is configured to generate the direction-emphasized sound field SH coefficient data 156 using a more efficient process. Defining $1^{(Q)}$ as a Q-dimensional vector of ones, $I^{(Q)}$ as the Q×Q identity matrix, and the matrix $A^{(QL)}=I^{(Q)}\otimes 1^{(L)}$, such that $B^{(Q)}\otimes 1^{(L)}=A^{(LQ)}B^{(Q)}$, then Eq. (15) may be rewritten as:

$$\tilde{B}^{(P)} = (\mathrm{diag}^{-1}(g^{(P)})\overline{C}^T A^{(LQ)} \mathrm{diag}(g^{(Q)}))B^{(Q)}, \quad \#(17)$$

where diag is a diagonal matrix with the argument vector along the diagonal and where $\overline{C}^T=C^T\circ[1^{(P)}\cdot(V^{(L)\otimes}1^{(Q)})^T]$. Because the quantity in parentheses in Eq. (17) is time invariant, that quantity may be computed offline. Accordingly, only PQ multiplies are needed for each time sample for the direction emphasis operation performed by the direction emphasis operation manager 150. Again, when Q=1 and L=2, there are four multiplies per output channel.

In some implementations, the direction emphasis acquisition manager 140 can be configured to generate the coefficients of the SH expansion of the direction emphasis function based on the sound field SH coefficient data 132. In this case, the generation is based on a particular formulation of the direction emphasis function in terms of time-dependent driving signals, assuming the pressure signal is a stationary stochastic process, as follows:

$$\nu(\theta', \phi', k) = \frac{E[|\mu(\theta', \phi', k, t)|^\alpha]}{\iint_\Omega E[|\mu(\theta', \phi', k, t)|^\alpha] \sin\theta' \, d\theta' \, d\phi'}, \quad \#(18)$$

where E an ensemble average that in practice can be approximated by an average over time (i.e., time samples) and $\alpha>1$ is a real constant. The denominator in Eq. (18) represents a normalization, so that the integral of v over the unit sphere is unity. The time-dependent driving signal may be written in a similar fashion to the time-independent formulation shown in Eq. (8) when $kr'\rightarrow\infty$:

$$\mu(\theta', \phi', k, t) = \frac{e^{jkr'}}{r'} \sum_{n=0}^{\infty} \sum_{m=-n}^{n} (-j)^n B_n^m(k, t) Y_n^m(\theta, \phi), \quad \#(19a)$$

or, in terms of a single sum, $$\mu(\theta', \phi', k, t) = \frac{e^{jkr'}}{r'} \sum_{q=0}^{\infty} (-j)^{n(q)} B_q Y_q. \quad \#(19b)$$

In the same limit ($kr'\rightarrow\infty$), the complex conjugate of the driving signal may be written as $$\mu^*(\theta', \phi', k, t) = \frac{e^{-jkr'}}{r'} \sum_{q=0}^{\infty} j^{n(q)} \breve{B}_q Y_q, \quad \#(20)$$

where $\breve{B}_n^m = B_n^{*-m}$. Again, the coefficients of the SH functions are time-dependent.

When $\alpha=2$, the direction emphasis function may be determined based on the sound field SH coefficient data 132. Thus, it can be shown that:

$$E[|\mu(\theta', \phi', k, t)|^2] = \frac{1}{r'^2} \sum_{l=0}^{\infty} \sum_{q=0}^{\infty} j^{n(l)-n(q)} E\left[B_l \breve{B}_q\right] Y_l Y_q. \quad \#(21)$$

Eq. (21) may then be written in terms of a single SH expansion as described previously. It is assumed here that the driving signal $\mu$ has a SH expansion that has been truncated with degree $\overline{Q}$, with the number of terms in the expansion being $Q=(\overline{Q}+1)^2$. When the direction emphasis function is normalized such that $v(\theta',\phi',k)=r'^2E[|\mu(\theta',\phi',k,t)|^2]$, the SH expansion of the direction emphasis function becomes $$v(\theta', \phi', k) = \sum_{i=0}^{P-1} Y_i \left( C^T \cdot \left[ E[g^{(Q)} \circ B^{(Q)}] \otimes E\left[g^{(Q)*} \otimes \breve{B}^{(Q)}\right] \right] \right)_i, \quad \#(22)$$

where $P=(2\overline{Q}+1)^2$. Note that the expression derived in Eq. (22) can be used to compute an emphasized monopole density and an emphasized pressure field by using Eqs. (14) and (16), respectively.

Accordingly, the direction emphasis acquisition manager 140 can be configured to generate the direction emphasis SH coefficient data 142 according to Eq. (22) with the above assumptions. The direction emphasis acquisition manager 140 also can be configured to generate the ensemble average of the sound field SH coefficient data 132 to perform the generation of the direction emphasis SH coefficient data 142.

Figure 3:
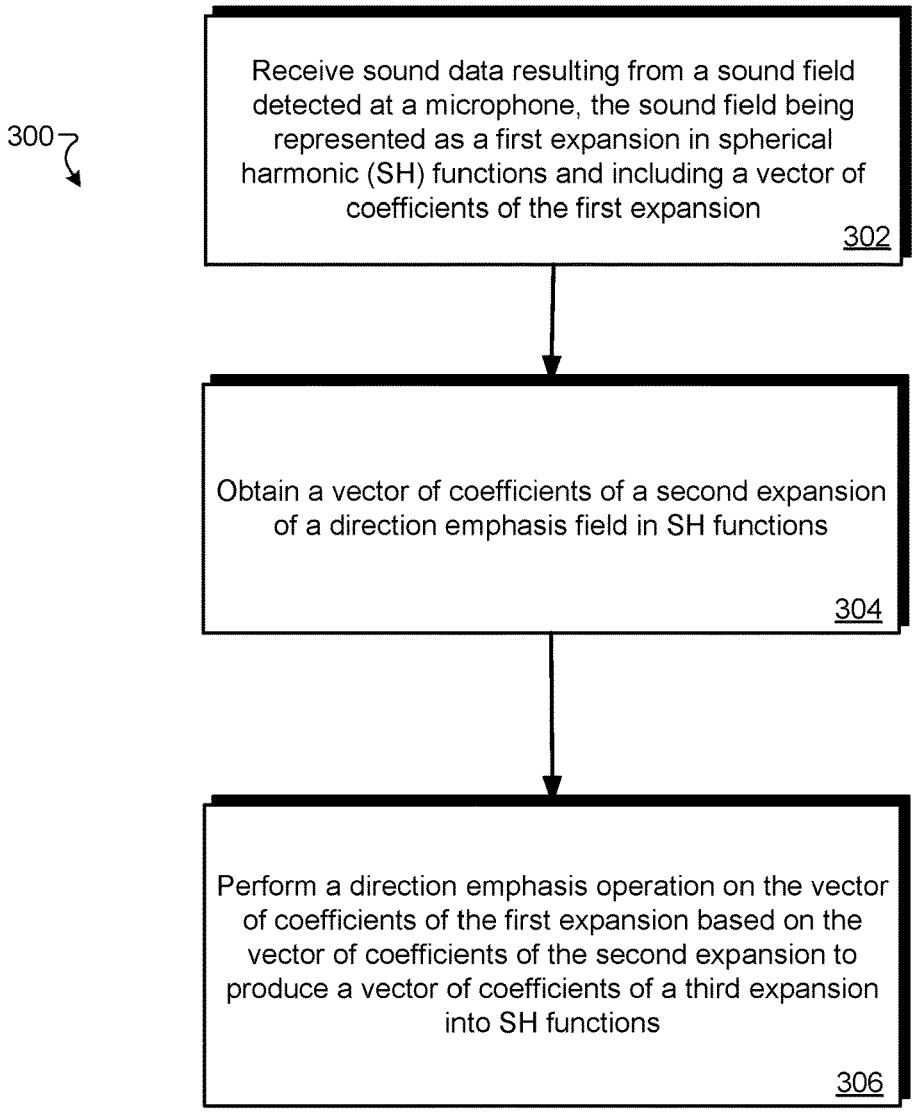
FIG. 3 is a flow chart that illustrates an example method of performing the improved techniques within the electronic environment shown in FIG. 1.

FIG. 3 is a flow chart that illustrates an example method 300 of rendering high-order ambisonics (HOA). The method 300 may be performed by software constructs described in connection with FIG. 1, which reside in memory 126 of the sound rendering computer 120 and which are run by the set of processing units 124.

At 302, the sound acquisition manager 130 receives sound data resulting from a sound field detected at a microphone. The sound field is represented as a first expansion in spherical harmonic (SH) functions including a vector of coefficients of the first expansion, e.g., the vector $B^{(Q)}$.

At 304, the direction emphasis acquisition manager 140 obtains a vector of coefficients of a second expansion of a direction emphasis field in SH functions, e.g., the vector $V^{(L)}$. The direction emphasis field v defines a direction-emphasized monopole density field $\tilde{\mu}$ upon multiplication with a monopole density field $\mu$, e.g., as in Eq. (9). It is noted that the neither the monopole density field nor the direction-emphasized monopole density field are computed. Rather, the concepts of the fields provides the basis for defining the direction emphasis field. The monopole density field $\mu$, when represented as an expansion in SH functions, includes a vector of coefficients. The vector of coefficients of the expansion is based on the vector of coefficients of the first expansion, e.g., as in Eq. 7b.

At 306, the direction emphasis operation manager 150 performs a direction emphasis operation, e.g., Eq. (15), on the vector of coefficients of the first expansion based on the vector of coefficients of the second expansion to produce a vector of coefficients of a third expansion into SH functions, e.g., $\tilde{B}^{(Q)}$. The third expansion represents a direction-emphasized sound field, e.g., $\tilde{p}$, that reproduces a directional sound field with a perceived directionality and timbre.

In some implementations, the conversion matrix generation manager 152 conversion matrix data, e.g., conversion matrix data 152 representing a conversion matrix, e.g., C defined in Eq. (13), resulting from conversion of an expansion in pairs of SHs into an expansion over single SHs. The direction emphasis operation manager 150 then producing the vector of coefficients of the third expansion based on the conversion matrix.

In some implementations, the conversion matrix generation manager 152 generates, as an element of the conversion matrix, a Clebsch-Gordan coefficient representing a weight of a SH function in the expansion in pairs of SHs. In some implementations, the conversion matrix generation manager 152 generates the elements of the conversion matrix by generating a plurality of points on a unit sphere $\{(\theta_i,\phi_i)\}_{i\in\{0,\ldots,P-1\}}$, generating, at each of the plurality of points, samples of a first vector of SH functions $Y^{(Q)}$ to produce a first matrix, a second vector of SH functions $Y^{(L)}$ to produce a second matrix, and samples of a third vector of SH functions $Y^{(P)}$ to produce a third matrix; and producing, as the conversion matrix, a product of an inverse of the third matrix of SH functions, e.g., P column vectors $Y^{(P)}(\theta_i,\phi_i)$ and a Kronecker product of the first matrix and the second matrix of SH functions, e.g., $\mathrm{vect}[Y^{(Q)}(\theta_i,\phi_i)Y^{(L)}(\theta_i,\phi_i)]$.

In some implementations, the direction emphasis operation manager 150 generates a Kronecker product of the vector of coefficients of the first expansion and the vector of coefficients of the second expansion to produce a vector of coefficient products, e.g., $B^{(Q)}\otimes V^{(L)}$ in Eq. (15). The direction emphasis operation manager 150 then produces, as the vector of coefficients of the third expansion, a product of a transpose of the conversion matrix and the vector of coefficient products, e.g., as in Eq. (15).

In some implementations, the direction emphasis operation manager 150 generates a Kronecker product of the vector of coefficients of the second expansion and a first vector of ones to produce a first product vector, e.g., $V^{(L)}\otimes 1^{(Q)}$ in Eq. (17). The direction emphasis operation manager 150 then generates a product of a second vector of ones and a transpose of the first product vector to produce a second product vector, e.g., $1^{(P)}\cdot(V^{(L)}\otimes 1^{(Q)})^T$ in Eq. (17). The direction emphasis operation manager 150 then generates a Hadamard product of a transpose of the conversion matrix and the second product vector to produce a second conversion matrix, e.g. $\overline{C}^T=C^T\circ[1^{(P)}\cdot V^{(L)}\otimes 1^{(Q)})^T]$ in Eq. (17). The direction emphasis operation manager 150 then generates a Kronecker product of an identity matrix and a third vector of ones to produce a matrix of units, e.g., $A^{(QL)}=I^{(Q)}\otimes 1^{(L)}$ in Eq. (17). The direction emphasis operation manager 150 then produces, as the vector of coefficients of the fourth expansion, a product of a transpose of the second conversion matrix, the matrix of units, and the vector of coefficients of the first expansion, e.g., $\tilde{B}^{(P)}=(\mathrm{diag}^{-1}(g^{(P)})\overline{C}^T A^{(LQ)}\mathrm{diag}(g^{(Q)}))B^{(Q)}$ in Eq. (17), where $g^{(Q)}$ is a vector whose $q^{th}$ element is $(-j)^{n(q)}$, and so on.

In some implementations, the direction emphasis acquisition manager 140 performs an ensemble average over time of a power of a magnitude of the monopole density field, e.g., as in Eq. (18). In some implementations, the power is equal to 2. In that case, the direction emphasis acquisition manager 140 generating an ensemble average over time of a Kronecker product of the vector of coefficients of the first expansion and a complex conjugate of the vector of coefficients of the first expansion to produce a first vector of ensemble-averaged coefficient products, e.g., as in Eq. (22) with the complex conjugate being the vector $\check{B}^{(Q)}$. The direction emphasis acquisition manager 140 then generates a Hadamard product of a vector of powers of an imaginary unit, e.g., g and the first vector of ensemble-averaged coefficient products to produce a second vector of ensemble-averaged coefficient products, e.g., as in Eq. (22). The direction emphasis acquisition manager 140 then produces, as an element of the vector of coefficients of the second expansion, a product of a transpose of the conversion matrix and a corresponding element of the second vector of ensemble-averaged coefficient products, e.g., as in Eq. (22). Again, it is noted that, in the framework described here, the ensemble average may be approximated with a time average.

In some implementations, the vector of coefficients of the second expansion is based on the vector of coefficients of the first expansion.

In some implementations, the memory 126 can be any type of memory such as a random-access memory, a disk drive memory, flash memory, and/or so forth. In some implementations, the memory 126 can be implemented as more than one memory component (e.g., more than one RAM component or disk drive memory) associated with the components of the sound rendering computer 120. In some implementations, the memory 126 can be a database memory. In some implementations, the memory 126 can be, or can include, a non-local memory. For example, the memory 126 can be, or can include, a memory shared by multiple devices (not shown). In some implementations, the memory 126 can be associated with a server device (not shown) within a network and configured to serve the components of the sound rendering computer 120.

The components (e.g., managers, processing units 124) of the sound rendering computer 120 can be configured to operate based on one or more platforms (e.g., one or more similar or different platforms) that can include one or more types of hardware, software, firmware, operating systems, runtime libraries, and/or so forth.

The components of the sound rendering computer 120 can be, or can include, any type of hardware and/or software configured to process attributes. In some implementations, one or more portions of the components shown in the components of the sound rendering computer 120 in FIG. 1 can be, or can include, a hardware-based module (e.g., a digital signal processor (DSP), a field programmable gate array (FPGA), a memory), a firmware module, and/or a software-based module (e.g., a module of computer code, a set of computer-readable instructions that can be executed at a computer). For example, in some implementations, one or more portions of the components of the sound rendering computer 120 can be, or can include, a software module configured for execution by at least one processor (not shown). In some implementations, the functionality of the components can be included in different modules and/or different components than those shown in FIG. 1.

In some implementations, the components of the sound rendering computer 120 (or portions thereof) can be configured to operate within a network. Thus, the components of the sound rendering computer 120 (or portions thereof) can be configured to function within various types of network environments that can include one or more devices and/or one or more server devices. For example, the network can be, or can include, a local area network (LAN), a wide area network (WAN), and/or so forth. The network can be, or can include, a wireless network and/or wireless network implemented using, for example, gateway devices, bridges, switches, and/or so forth. The network can include one or more segments and/or can have portions based on various protocols such as Internet Protocol (IP) and/or a proprietary protocol. The network can include at least a portion of the Internet.

In some embodiments, one or more of the components of the sound rendering computer 120 can be, or can include, processors configured to process instructions stored in a memory. For example, the sound acquisition manager 130 (and/or a portion thereof), the direction emphasis acquisition manager 140 (and/or a portion thereof), and the direction emphasis operation manager 150 (and/or a portion thereof can include a combination of a memory storing instructions related to a process to implement one or more functions and a configured to execute the instructions.

Figure 4:
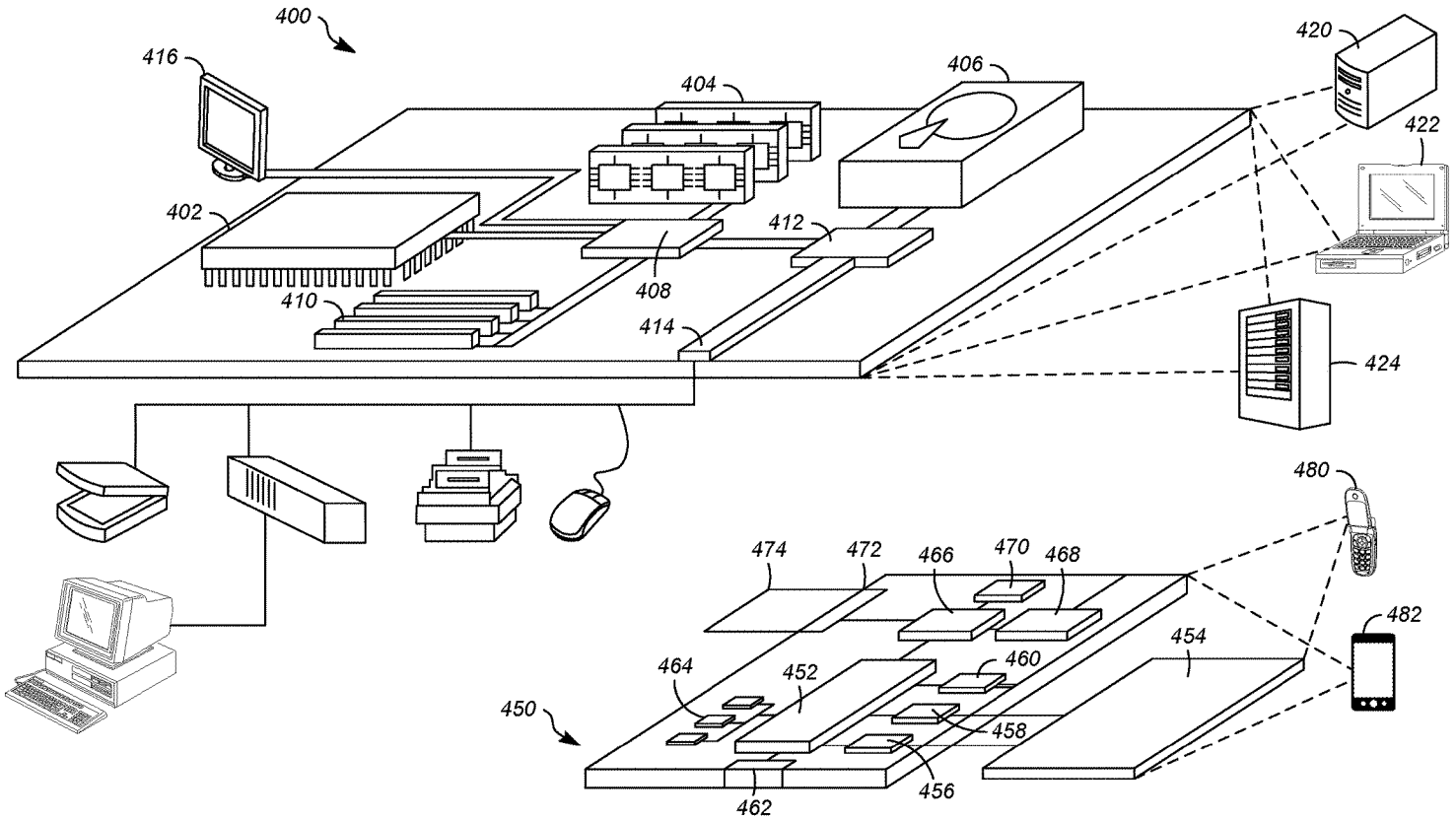
FIG. 4 illustrates an example of a computer device and a mobile computer device that can be used with circuits described here.

FIG. 4 shows an example of a computer device 400 and a mobile computer device 450, which may be used with the techniques described here. The computing device 400 is intended to represent various forms of digital computers, such as laptops, desktops, tablets, workstations, personal digital assistants, televisions, servers, blade servers, mainframes, and other appropriate computing devices. The computing device 450 is intended to represent various forms of mobile devices, such as personal digital assistants, cellular telephones, smart phones, and other similar computing devices. The components shown here, their connections and relationships, and their functions, are meant to be exemplary only, and are not meant to limit implementations of the inventions described and/or claimed in this document.

The computing device 400 includes a processor 402, memory 404, a storage device 406, a high-speed interface 408 connecting to memory 404 and high-speed expansion ports 410, and a low speed interface 412 connecting to low speed bus 414 and storage device 406. The processor 402 can be a semiconductor-based processor. The memory 404 can be a semiconductor-based memory. Each of the components 402, 404, 406, 408, 410, and 412, are interconnected using various busses, and may be mounted on a common motherboard or in other manners as appropriate. The processor 402 can process instructions for execution within the computing device 400, including instructions stored in the memory 404 or on the storage device 406 to display graphical information for a GUI on an external input/output device, such as display 416 coupled to high speed interface 408. In other implementations, multiple processors and/or multiple buses may be used, as appropriate, along with multiple memories and types of memory. Also, multiple computing devices 400 may be connected, with each device providing portions of the necessary operations (e.g., as a server bank, a group of blade servers, or a multi-processor system).

The memory 404 stores information within the computing device 400. In one implementation, the memory 404 is a volatile memory unit or units. In another implementation, the memory 404 is a non-volatile memory unit or units. The memory 404 may also be another form of computer-readable medium, such as a magnetic or optical disk.

The storage device 406 is capable of providing mass storage for the computing device 400. In one implementation, the storage device 406 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 404, the storage device 406, or memory on processor 402.

The high speed controller 408 manages bandwidth-intensive operations for the computing device 400, while the low speed controller 412 manages lower bandwidth-intensive operations. Such allocation of functions is exemplary only. In one implementation, the high-speed controller 408 is coupled to memory 404, display 416 (e.g., through a graphics processor or accelerator), and to high-speed expansion ports 410, which may accept various expansion cards (not shown). In the implementation, low-speed controller 412 is coupled to storage device 406 and low-speed expansion port 414. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 400 may be implemented in a number of different forms, as shown in the figure. For example, it may be implemented as a standard server 420, or multiple times in a group of such servers. It may also be implemented as part of a rack server system 424. In addition, it may be implemented in a personal computer such as a laptop computer 422. Alternatively, components from computing device 400 may be combined with other components in a mobile device (not shown), such as device 450. Each of such devices may contain one or more of computing device 400, 450, and an entire system may be made up of multiple computing devices 400, 450 communicating with each other.

The computing device 450 includes a processor 452, memory 464, an input/output device such as a display 454, a communication interface 466, and a transceiver 468, among other components. The device 450 may also be provided with a storage device, such as a microdrive or other device, to provide additional storage. Each of the components 450, 452, 464, 454, 466, and 468, are interconnected using various buses, and several of the components may be mounted on a common motherboard or in other manners as appropriate.

The processor 452 can execute instructions within the computing device 450, including instructions stored in the memory 464. The processor may be implemented as a chipset of chips that include separate and multiple analog and digital processors. The processor may provide, for example, for coordination of the other components of the device 450, such as control of user interfaces, applications run by device 450, and wireless communication by device 450.

Processor 452 may communicate with a user through control interface 458 and display interface 456 coupled to a display 454. The display 454 may be, for example, a TFT LCD (Thin-Film-Transistor Liquid Crystal Display) or an OLED (Organic Light Emitting Diode) display, or other appropriate display technology. The display interface 456 may comprise appropriate circuitry for driving the display 454 to present graphical and other information to a user. The control interface 458 may receive commands from a user and convert them for submission to the processor 452. In addition, an external interface 462 may be provided in communication with processor 452, so as to enable near area communication of device 450 with other devices. External interface 462 may provide, for example, for wired communication in some implementations, or for wireless communication in other implementations, and multiple interfaces may also be used.

The memory 464 stores information within the computing device 450. The memory 464 can be implemented as one or more of a computer-readable medium or media, a volatile memory unit or units, or a non-volatile memory unit or units. Expansion memory 474 may also be provided and connected to device 450 through expansion interface 472, which may include, for example, a SIMM (Single In Line Memory Module) card interface. Such expansion memory 474 may provide extra storage space for device 450, or may also store applications or other information for device 450. Specifically, expansion memory 474 may include instructions to carry out or supplement the processes described above, and may include secure information also. Thus, for example, expansion memory 474 may be provide as a security module for device 450, and may be programmed with instructions that permit secure use of device 450. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 464, expansion memory 474, or memory on processor 452 that may be received, for example, over transceiver 468 or external interface 462.

The computing device 450 may communicate wirelessly through communication interface 466, which may include digital signal processing circuitry where necessary. Communication interface 466 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 468. In addition, short-range communication may occur, such as using a Bluetooth, Wi-Fi, or other such transceiver (not shown). In addition, GPS (Global Positioning System) receiver module 470 may provide additional navigation- and location-related wireless data to device 450, which may be used as appropriate by applications running on device 450.

The computing device 450 may also communicate audibly using audio codec 460, which may receive spoken information from a user and convert it to usable digital information. Audio codec 460 may likewise generate audible sound for a user, such as through a speaker, e.g., in a handset of device 450. Such sound may include sound from voice telephone calls, may include recorded sound (e.g., voice messages, music files, etc.) and may also include sound generated by applications operating on device 450.

The computing device 450 may be implemented in a number of different forms, as shown in the figure. For example, it may be implemented as a cellular telephone 480. It may also be implemented as part of a smart phone 482, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

Although certain example methods, apparatuses and articles of manufacture have been described herein, the scope of coverage of this patent is not limited thereto. It is to be understood that terminology employed herein is for the purpose of describing particular aspects, and is not intended to be limiting. On the contrary, this patent covers all methods, apparatus and articles of manufacture fairly falling within the scope of the claims of this patent.

What is claimed is:

1. A method, comprising:

receiving, by controlling circuitry of a sound rendering computer configured to render directional sound fields for a listener, sound data resulting from a sound field detected at a microphone, the sound field being represented as a first expansion in spherical harmonic (SH) functions and including a vector of coefficients of the first expansion;

obtaining, by the controlling circuitry, a vector of coefficients of a second expansion of a direction emphasis field in SH functions, the direction emphasis field producing a direction-emphasized monopole density field upon multiplication with a monopole density field; and performing, by the controlling circuitry, a direction emphasis operation on the vector of coefficients of the first expansion based on the vector of coefficients of the second expansion to produce a vector of coefficients of a third expansion into SH functions, the third expansion representing a direction-emphasized sound field that reproduces a directional sound field with a perceived directionality and timbre.

2. The method of claim 1, wherein performing the direction emphasis operation includes:

generating conversion matrix data representing a conversion matrix resulting from conversion of an expansion in pairs of SHs into an expansion over single SHs; and producing the vector of coefficients of the third expansion based on the conversion matrix.

3. The method of claim 2, wherein generating the conversion matrix data includes:

generating, as an element of the conversion matrix, a Clebsch-Gordan coefficient representing a weight of a SH function in the expansion in pairs of SHs.

4. The method of claim 2, wherein performing the direction emphasis operation further includes:

generating a Kronecker product of the vector of coefficients of the first expansion and the vector of coefficients of the second expansion to produce a vector of coefficient products; and producing, as the vector of coefficients of the third expansion, a product of a transpose of the conversion matrix and the vector of coefficient products.

5. The method of claim 1, wherein the direction emphasis field is proportional to an ensemble average over time of a power of a magnitude of the monopole density field.

6. The method of claim 5, wherein the power is equal to 2, and wherein obtaining the vector of coefficients of the second expansion includes:

generating an ensemble average over time of a Kronecker product of the vector of coefficients of the first expansion and a complex conjugate of the vector of coefficients of the first expansion to produce a first vector of ensemble-averaged coefficient products;

generating a Hadamard product of a vector of powers of an imaginary unit and the first vector of ensemble-averaged coefficient products to produce a second vector of ensemble-averaged coefficient products; and producing, as an element of the vector of coefficients of the second expansion, a product of a transpose of the conversion matrix and a corresponding element of the second vector of ensemble-averaged coefficient products.

7. The method of claim 1, wherein the vector of coefficients of the second expansion is based on the vector of coefficients of the first expansion.

8. A computer program product comprising a non-transitory storage medium, the computer program product including code that, when executed by processing circuitry of a sound rendering computer configured to render directional sound fields for a listener, causes the processing circuitry to:

receive sound data resulting from a sound field detected at a microphone, the sound field being represented as a first expansion in spherical harmonic (SH) functions and including a vector of coefficients of the first expansion;

obtain a vector of coefficients of a second expansion of a direction emphasis field in SH functions, the direction emphasis field producing a direction-emphasized monopole density field upon multiplication with a monopole density field; and perform a direction emphasis operation on the vector of coefficients of the first expansion based on the vector of coefficients of the second expansion to produce a vector of coefficients of a third expansion into SH functions, the third expansion representing a direction-emphasized sound field that reproduces a directional sound field with a perceived directionality and timbre.

9. The computer program product of claim 8, wherein performing the direction emphasis operation includes:

generating conversion matrix data representing a conversion matrix resulting from conversion of an expansion in pairs of SHs into an expansion over single SHs; and producing the vector of coefficients of the third expansion based on the conversion matrix.

10. The computer program product of claim 9, wherein generating the conversion matrix data includes:

generating a plurality of points on a unit sphere; and producing the conversion matrix based on the plurality of points on the unit sphere.

11. The computer program product of claim 9, wherein performing the direction emphasis operation further includes:

generating a Kronecker product of the vector of coefficients of the second expansion and a first vector of ones to produce a first product vector;

generating a product of a second vector of ones and a transpose of the first product vector to produce a second product vector;

generating a Hadamard product of a transpose of the conversion matrix and the second product vector to produce a second conversion matrix;

generating a Kronecker product of an identity matrix and a third vector of ones to produce a matrix of units; and producing, as the vector of coefficients of the third expansion, a product of a transpose of the second conversion matrix, the matrix of units, and the vector of coefficients of the first expansion.

12. The computer program product of claim 8, wherein the direction emphasis field is proportional to an ensemble average over time of a power of a magnitude of the monopole density field.

13. The computer program product of claim 12, wherein the power is equal to 2, and wherein obtaining the vector of coefficients of the second expansion includes:

generating an ensemble average over time of a Kronecker product of the vector of coefficients of the first expansion and a complex conjugate of the vector of coefficients of the first expansion to produce a first vector of ensemble-averaged coefficient products;

generating a Hadamard product of a vector of powers of an imaginary unit and the first vector of ensemble-averaged coefficient products to produce a second vector of ensemble-averaged coefficient products; and producing, as an element of the vector of coefficients of the second expansion, a product of a transpose of the conversion matrix and a corresponding element of the second vector of ensemble-averaged coefficient products.

14. The computer program product of claim 8, wherein the vector of coefficients of the second expansion is based on the vector of coefficients of the first expansion.

15. An electronic apparatus configured to render directional sound fields for a listener, the electronic apparatus comprising:

memory; and controlling circuitry coupled to the memory, the controlling circuitry being configured to:

receive sound data resulting from a sound field detected at a microphone, the sound field being represented as a first expansion in spherical harmonic (SH) functions and including a vector of coefficients of the first expansion;

obtain a vector of coefficients of a second expansion of a direction emphasis field in SH functions, the direction emphasis field producing a direction-emphasized monopole density field upon multiplication with a monopole density field; and perform a direction emphasis operation on the vector of coefficients of the first expansion based on the vector of coefficients of the second expansion to produce a vector of coefficients of a third expansion into SH functions, the third expansion representing a direction-emphasized sound field that reproduces a directional sound field with a perceived directionality and timbre.

16. The electronic apparatus of claim 15, wherein the controlling circuitry configured to perform the direction emphasis operation is further configured to:

generate conversion matrix data representing a conversion matrix resulting from conversion of an expansion in pairs of SHs into an expansion over single SHs; and produce the vector of coefficients of the third expansion based on the conversion matrix.

17. The electronic apparatus of claim 16, wherein the controlling circuitry configured to generate the conversion matrix data is further configured to:

generate a plurality of points on a unit sphere; and produce the conversion matrix based on the plurality of points on the unit sphere.

18. The electronic apparatus of claim 16, wherein the controlling circuitry configured to perform the direction emphasis operation further is further configured to:

generate a Kronecker product of the vector of coefficients of the second expansion and a first vector of ones to produce a first product vector;

generate a product of a second vector of ones and a transpose of the first product vector to produce a second product vector;

generate a Hadamard product of a transpose of the conversion matrix and the second product vector to produce a second conversion matrix;

generate a Kronecker product of an identity matrix and a third vector of ones to produce a matrix of units; and produce, as the vector of coefficients of the third expansion, a product of a transpose of the second conversion matrix, the matrix of units, and the vector of coefficients of the first expansion.

19. The electronic apparatus of claim 15, wherein the direction emphasis field is proportional to an ensemble average over time of a power of a magnitude of the monopole density field.

20. The electronic apparatus of claim 19, wherein the power is equal to 2, and wherein the controlling circuitry configured to obtain the vector of coefficients of the second expansion is further configured to:

generate an ensemble average over time of a Kronecker product of the vector of coefficients of the first expansion and a complex conjugate of the vector of coefficients of the first expansion to produce a first vector of ensemble-averaged coefficient products;

generate a Hadamard product of a vector of powers of an imaginary unit and the first vector of ensemble-averaged coefficient products to produce a second vector of ensemble-averaged coefficient products; and produce, as an element of the vector of coefficients of the second expansion, a product of a transpose of the conversion matrix and a corresponding element of the second vector of ensemble-averaged coefficient products.

* * * * *